US007077596B1

(12) United States Patent
Bianco et al.

(10) Patent No.: US 7,077,596 B1
(45) Date of Patent: Jul. 18, 2006

(54) NOTEBOOK WITH TWO-WAY POCKET

(75) Inventors: Ronald M. Bianco, Laguna Beach, CA (US); Douglas M. Jack, Fullerton, CA (US)

(73) Assignee: MeadWestvaco Corporation, Stamford, CT (US)

( * ) Notice: Subject to any disclaimer, the term of this patent is extended or adjusted under 35 U.S.C. 154(b) by 0 days.

(21) Appl. No.: 10/130,679

(22) PCT Filed: Nov. 17, 2000

(86) PCT No.: PCT/US00/42224

§ 371 (c)(1),
(2), (4) Date: Oct. 24, 2002

(87) PCT Pub. No.: WO01/36211

PCT Pub. Date: May 25, 2001

Related U.S. Application Data

(60) Provisional application No. 60/166,067, filed on Nov. 17, 1999.

(51) Int. Cl.
*B42F 13/00* (2006.01)

(52) U.S. Cl. ..... 402/73; 402/4; 402/70; 402/80 R; 281/15.1; 281/20; 281/29; 281/31; 281/51; 283/117; 206/232; 206/307; D19/26; D19/32; D19/65; D19/75

(58) Field of Classification Search ..... 402/4, 402/70, 73, 79, 80 R, 500, 502; D19/26, D19/27, 32, 33, 65, 75; 281/15.1, 20, 29, 281/31, 51; 283/117; 206/233, 307; 150/145; 229/67.1, 71–72; 190/901; 312/7.1, 9.64; 379/428.01; 455/117, 269
See application file for complete search history.

(56) References Cited

U.S. PATENT DOCUMENTS

| | | | | | |
|---|---|---|---|---|---|
| 2,088,953 | A | * | 8/1937 | Greer | 281/31 |
| 3,912,055 | A | * | 10/1975 | Malooly | 190/109 |
| 4,004,689 | A | * | 1/1977 | Glasell | 206/387.13 |
| 4,067,422 | A | * | 1/1978 | Eberle | 190/112 |
| 4,840,258 | A | * | 6/1989 | Tomikawa et al. | 190/102 |
| 5,255,779 | A | * | 10/1993 | Koenig, III | 206/232 |
| 5,255,835 | A | | 10/1993 | Burks | |
| 5,294,208 | A | * | 3/1994 | Tremmel et al. | 402/70 |
| 5,348,347 | A | | 9/1994 | Shink | |
| 5,489,021 | A | | 2/1996 | Wallingford | |
| 5,494,366 | A | * | 2/1996 | Pell et al. | 402/73 |
| 5,924,736 | A | * | 7/1999 | Russo | 281/38 |

(Continued)

*Primary Examiner*—Boyer D. Ashley
*Assistant Examiner*—Eric A. Gates
(74) *Attorney, Agent, or Firm*—Thomas A. Boshinski

(57) ABSTRACT

A two-way pocket assembly for use with a notebook (100). The pocket assembly is constructed over a window (208) formed in a subsurface material of the notebook (100). The pocket assembly includes exterior and interior pockets (104), each covering at least a portion of the window (208). The exterior and interior pockets (104) provide access to the pocket assembly from either the exterior (102) or interior (204) of the notebook (100). The pocket may be configured to receive and hold a personal electronic assistant, a cellular telephone (302), or another personal electronic device. The interior pocket includes a window material that allows visual access to the interior (204) of the pocket assembly through the material of the interior pocket (104). The pocket may be constructed so that a personal electronic assistant held inside the pocket assembly is usable through the window without removing the device from the pocket assembly.

12 Claims, 6 Drawing Sheets

U.S. PATENT DOCUMENTS 5,975,578 A * 11/1999 Mayer ..... 281/37
6,016,907 A * 1/2000 Dreier ..... 206/232
6,059,079 A * 5/2000 Krulik ..... 190/112
6,095,564 A 8/2000 Wien
6,123,127 A * 9/2000 Su ..... 150/116
6,161,979 A 12/2000 Yamamoto et al.
6,401,919 B1 * 6/2002 Griffis et al. ..... 206/307.1
6,837,346 B1 * 1/2005 Hollingsworth ..... 190/11
6,997,481 B1 * 2/2006 Hardwig ..... 281/29
2001/0039195 A1 * 11/2001 Nickum ..... 455/557
2004/0099496 A1 * 5/2004 Hollingsworth ..... 190/111

* cited by examiner

FIG. 1
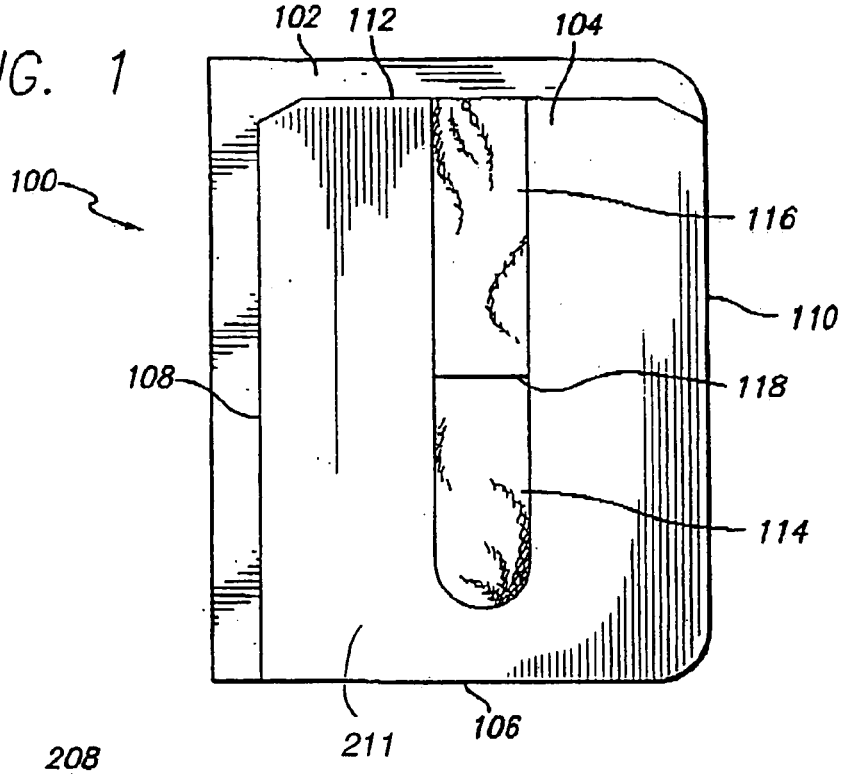
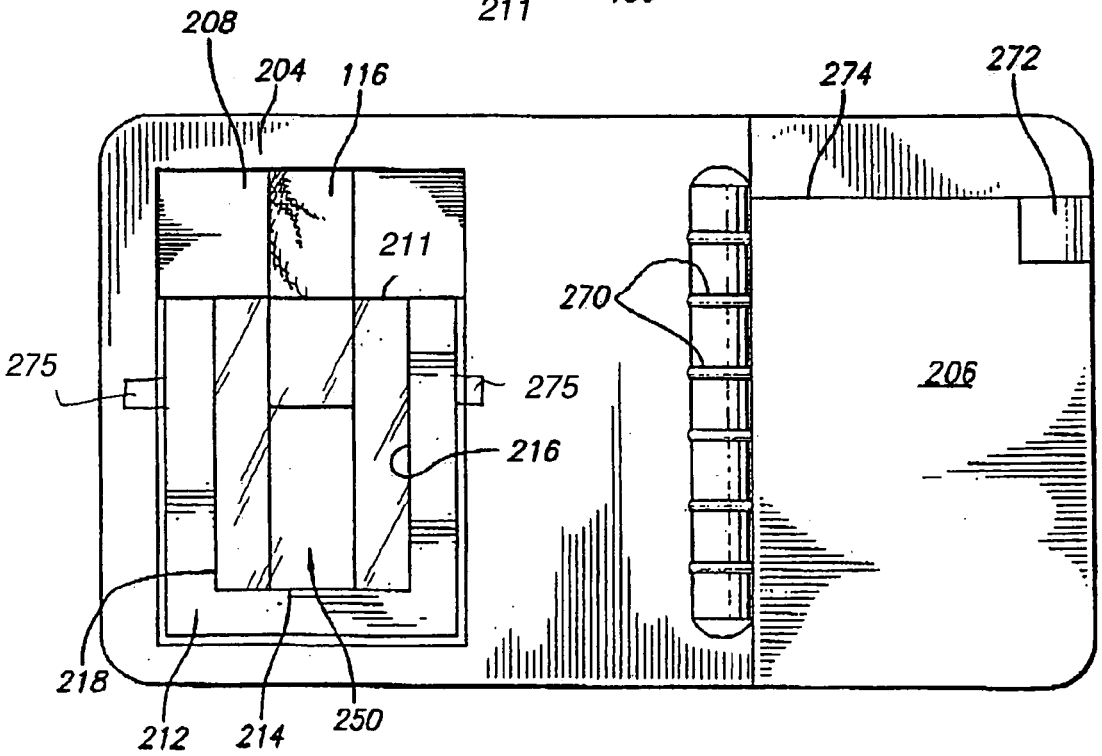
FIG. 2

272
208
204
302
116
206
ON
OFF
SEND
211
270

116
270
272
302
208
206
211

NOTEBOOK WITH TWO-WAY POCKET

CROSS-REFERENCE TO RELATED APPLICATION

The present application claims priority on the basis of U.S. provisional application Ser. No. 60/166,067 entitled "TWO WAY POCKET FOR A NOTEBOOK" filed on Nov. 17, 1999.

FIELD OF THE INVENTION

The present invention relates generally to notebooks and more particularly to notebooks capable of carrying and protecting devices referred to here as "personal electronic assistants."

BACKGROUND OF THE INVENTION

It is a practice of many people today to carry a notebook, such as a personal organizer, that contains information they require frequently for personal or business reasons. This information may include calendars, schedules, notes, addresses, telephone numbers and a wide variety of other information that the user prefers to have available in hard copy form.

Many such persons are also in the habit of carrying some type of "personal electronic assistant," a term that is used here to include such portable electronic devices as cellular telephones, Palm Pilots™ and other electronic organizers, beepers, e-mail devices, calculators and the like. To carry both an organizer and a personal electronic assistant is often inconvenient. One or more of these items can easily be lost, forgotten or dropped. It is, therefore, highly desirable to find a way to effectively combine these two items into one, while at the same time allowing them to be separated when it is advantageous to do so. It is also desirable that the notebook provide some measure of protection for the personal electronic assistant, which typically is subject to being damaged rather easily. It is most desirable that the personal electronic assistant be accessible whether the notebook is closed or open and that the personal electronic assistant be hidden from view when contained within the notebook.

SUMMARY OF THE INVENTION

The notebook of the present invention satisfies the above needs. It includes a foldable cover with internal and external surfaces, a rigid support sheet being enclosed within the cover. An external pocket flap is secured to the exterior surface, covering at least a part of the opening. An interior pocket flap is secured to the interior surface, likewise covering at least a part of the opening. A personal electronic assistant can be inserted in a storage pocket between the pocket flaps from the outside or inside of the notebook.

Elastic panels can be included to permit the pocket flaps to expand. A window can be provided in the interior flap to readily accept the personal electronic assistant. A window panel can be transparent or mesh or may be omitted entirely.

DESCRIPTION OF THE DRAWINGS

FIG. 1 is an elevational view showing the front exterior surface of a notebook that embodies the present invention in a closed position.

FIG. 2 is an elevational view showing the interior of the notebook of FIG. 1, with the notebook in an open position.

DESCRIPTION OF THE PREFERRED EMBODIMENTS

Figure 3:
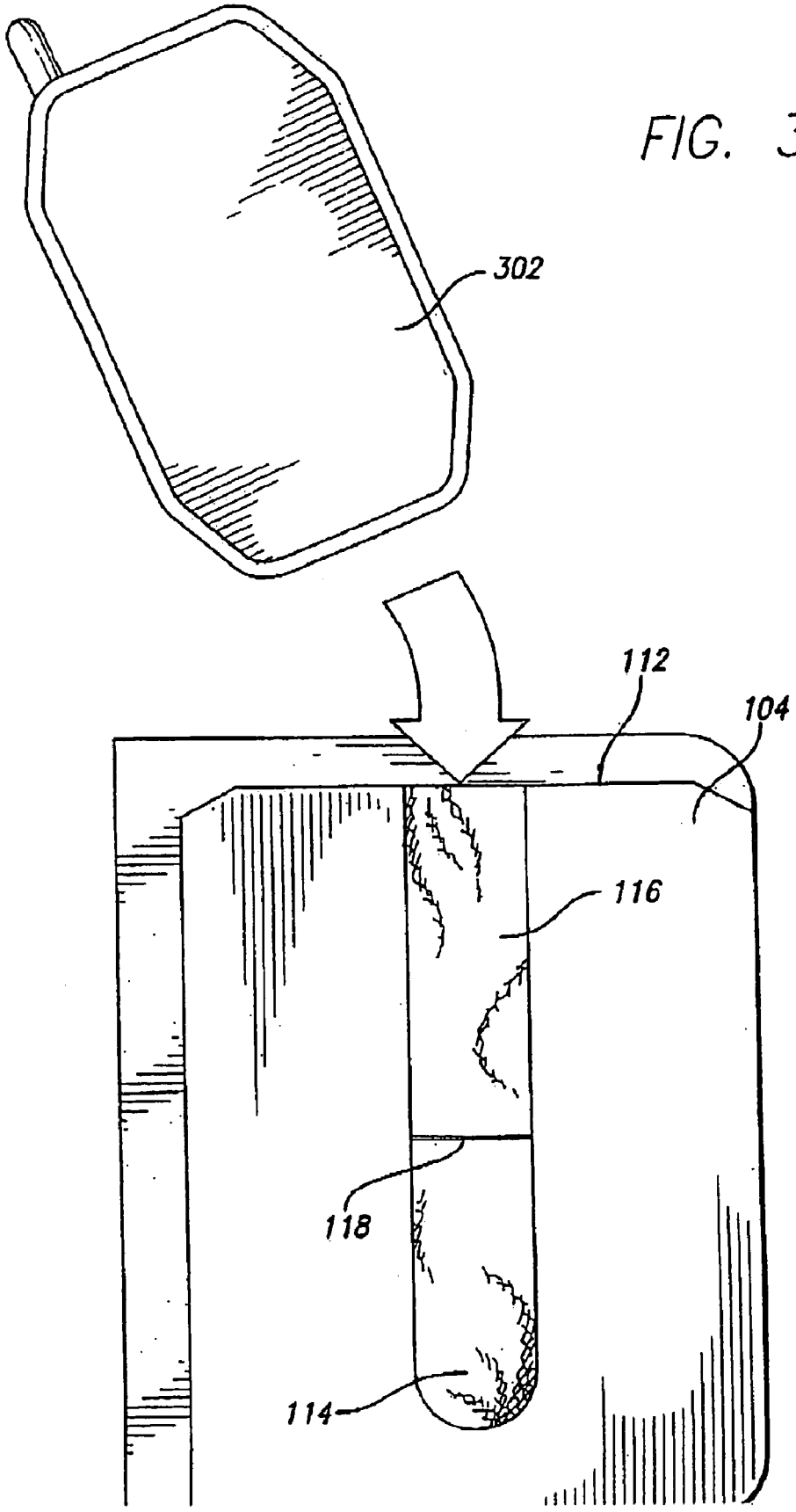
FIG. 3 is a perspective view of a cellular telephone or other personal electronic assistant that can be inserted and carried in a two-way pocket of the notebook of FIG. 1.

One preferred embodiment of the present invention is a notebook 100 with a two-way storage and receiving pocket 104 that permits, enables and facilitates the retention of a personal electronic assistant, such as a cell phone, pager, calculator, beeper, e-mail device, or electronic organizer. A front exterior surface 102, a front interior surface 204, and a rear interior surface 206 are shown in FIGS. 1 and 2. Preferably, the notebook 100 also includes a zipper or other fastener, such as hook and loop (Velcro™) or a snap closure (not shown) located at the outside opposite edge of the notebook, which allows the notebook to be secured in a closed position. The notebook 100 may also include such features as openable binder rings 270, a spiral or adhesive bound notepad, a pen loop 272, a stylus holder, a business card holder, a spare battery holder and a pocket for a pad of paper 274. Structurally the notebook 100 includes a support sheet 107 formed by a suitably stiff material such as chipboard, cardboard, hard plastic or laminated paper product, which is bound in and enclosed by an attractive cover made of leather, cloth, vinyl or plastic. The cover is foldable along a center axis and thereby closed, as shown in FIG. 1.

An opening 200 is provided in the support sheet 107 and cover of the notebook 100, centered on one side of the center axis of the cover, as shown in FIG. 2. Preferably, this opening 200 is formed by removing a large square or rectangular section of the support sheet before adding the cover. An exterior pocket flap 104 is attached to the front exterior surface 102 of the notebook 100 over the opening 200. Preferably, the pocket flap 104 is made of the same material as the cover or a similar material, e.g., leather, vinyl, plastic or fabric. The pocket flap 104 is firmly attached to the front exterior surface 102 of the notebook along a bottom edge 106, a fold edge 108, and a side edge 110. A top edge 112 of the pocket flap is left unattached and open to provide access to the interior of the storage pocket behind the pocket flap 104. The exterior pocket 104 may be integrally formed with the cover, but the use of a separately formed flap is advantageous. If desired, the top edge of the pocket flap 104 may be temporarily secured in a closed position by a hook and loop (Velcro™), snap or zipper closure, or the like (not shown). There are two tabs 275, one extending from each side of the interior of the pocket flap 104. Hook and loop (Velcro™) fasteners on these tabs allow them to be secured to the interior cover surface, thus reducing the storage pocket volume behind the flap 104.

Figure 9:
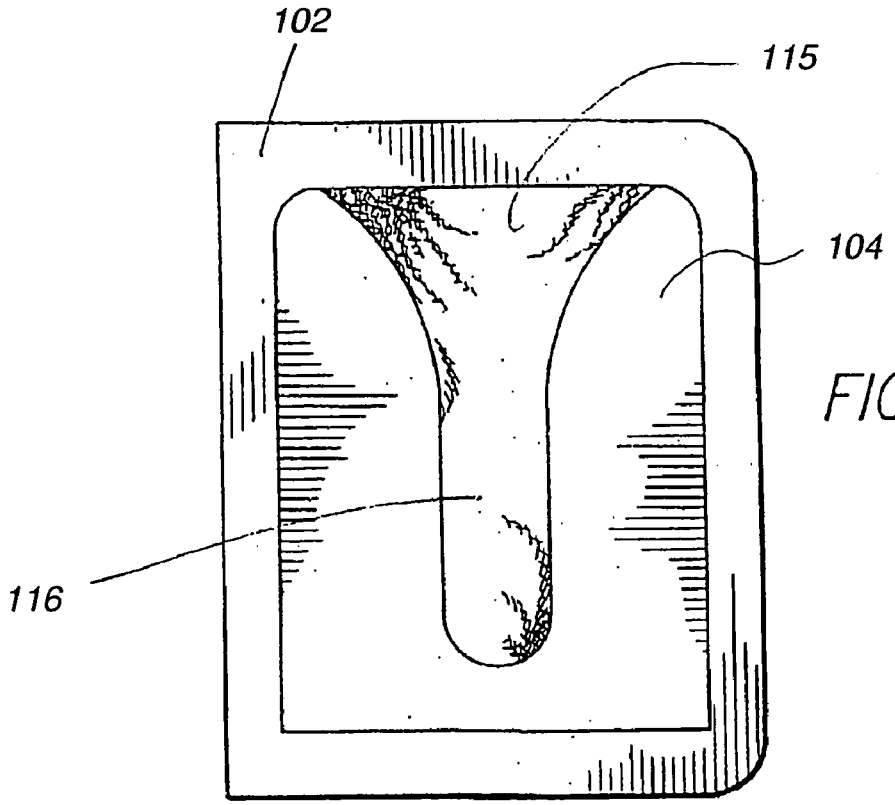
FIG. 9 illustrates an alternative embodiment of a notebook having a "Y-shaped" center cut-out that surrounds an elastic material.

An exterior pocket flap 210 aligned with the opening 208 and the interior flap 104 has a U-shaped center cutout 114 extending from the top edge 112 downwardly along the approximate center line of the flap (FIG. 1). It will be understood that the shape of the cut-out 114 can be varied as desired and can take such shapes as a "Y" (shown in FIG. 9) a circle (not shown) or an "S" (not shown). Attached to the exterior pocket flap 216 and extending across the U-shaped center cut-out 114 are one or more elastic panels or strips 116. It will be understood that the term "elastic" as used herein refers to any suitably resilient, stretchable material such as lycra, nylon, and other types of rubberized fabrics. The elastic panels 116 are firmly stitched, glued, or otherwise attached to the pocket flap 210 along the U-shaped center cutout 114, but are not attached to the front exterior surface 102 of the notebook 100, thus allowing access to the interior of the storage pocket via the top edge 112 of the exterior pocket flap 210. The panel or panels 116 make the storage pocket expandable and help to secure the contents thereof. This allows the a user of the notebook to insert items which are larger and bulkier than, for example, papers and which would not be insertable in a non-gusseted pocket of the same size without elastic panels.

A user of the notebook 100 can thus insert a cell phone 302 or other personal electronic assistant (shown in FIG. 3) into the storage pocket via the top edge 112, the storage pocket being appropriately sized for this use. When the cell phone is thus inserted, the elastic panels 116 stretch and the storage pocket 250 expands, allowing the cell phone 302 to be securely held in place. Additionally, the cell phone 302 is not visible when the notebook 100 is closed. If the article stored in the pocket is not too large, it will not be visible, or at least it will not be prominent when the notebook 100 is closed, as in FIG. 1.

With further reference to FIG. 2, when the notebook 100 is open and the front interior surface 204 is visible, the back side of the pocket flap 210 and the elastic panels 116 are visible through a window 208. Attached to the front interior surface 204 of the binder and covering all or a portion of the window 208 is a transparent panel 211 that forms part of the interior pocket flap 104. The window panel 208 can be made of any suitable transparent flexible plastic, or it can be made of mesh. The transparent panel 211 is firmly sewn, glued or otherwise attached to elastic strips 212 on the bottom edge 214, inside edge 216, and outside edge 218 of the interior pocket flap 104. In turn, the elastic strips 212 are firmly sewn or otherwise attached to three sides of either the front interior surface 204 and/or the pocket 104. Alternatively, the window 208 can be an opening, with no transparent panel 211. Preferably, the elastic strips 212 are configured so that they cause the transparent panel 211 to conform generally to the shape of and securely hold a personal electronic assistant.

Figure 4:
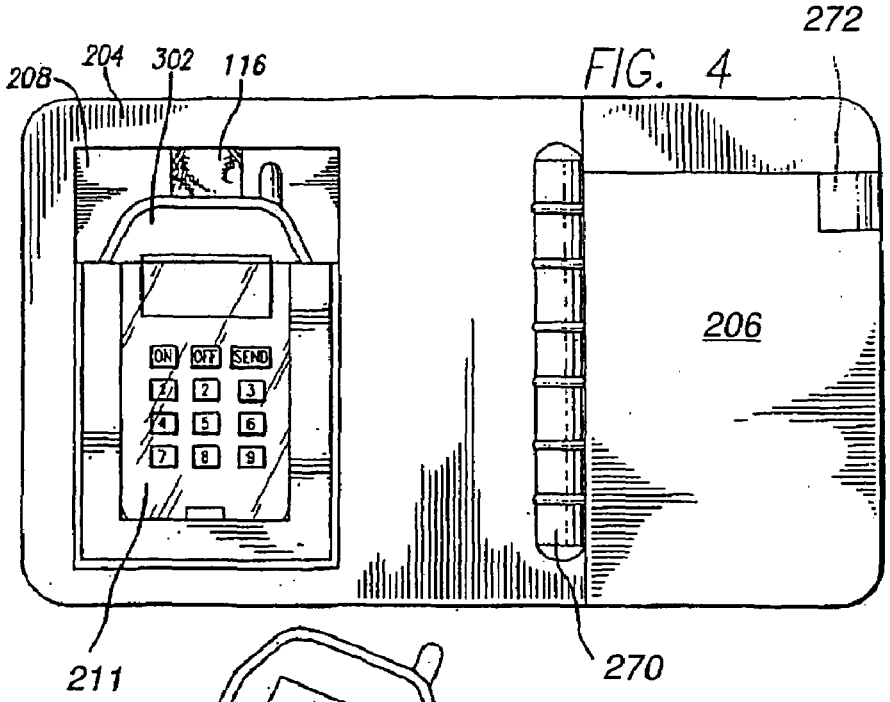
FIG. 4 shows the two-way pocket with a personal electronic device inserted in it, as viewed from the inside of the notebook of FIG. 1, with the notebook in an open position.
Figure 5:
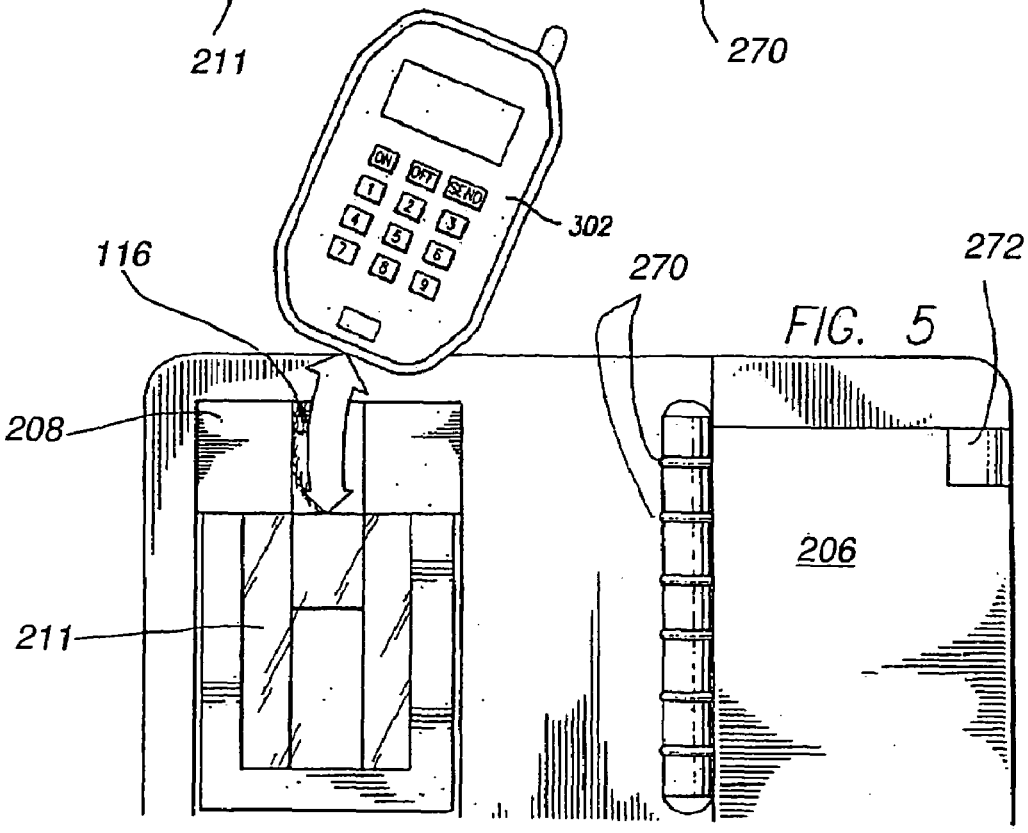
FIG. 5 is similar to FIG. 4 but shows the personal electronic assistant in the process of being inserted.

With reference to FIGS. 4 and 5, when a cell phone 302 or other personal electronic assistant is inserted into the storage pocket 250 from the front exterior surface 102 of the notebook 100, it is visible and accessible from the front interior surface 204. Because the interior pocket flap 104 is secured by the action of the elastic strips 212, the cell phone 302 will be firmly held in the storage pocket and can be seen through the transparent panel 211. The transparent panel 211 thus allows users of personal electronic assistants such as Palm Pilots,™ other handheld computers, and other electronic devices to see and use their video input/output screens and to access, for example, buttons of the cell phone 302, when the phone is secured in the storage pocket 250.

Figure 6:
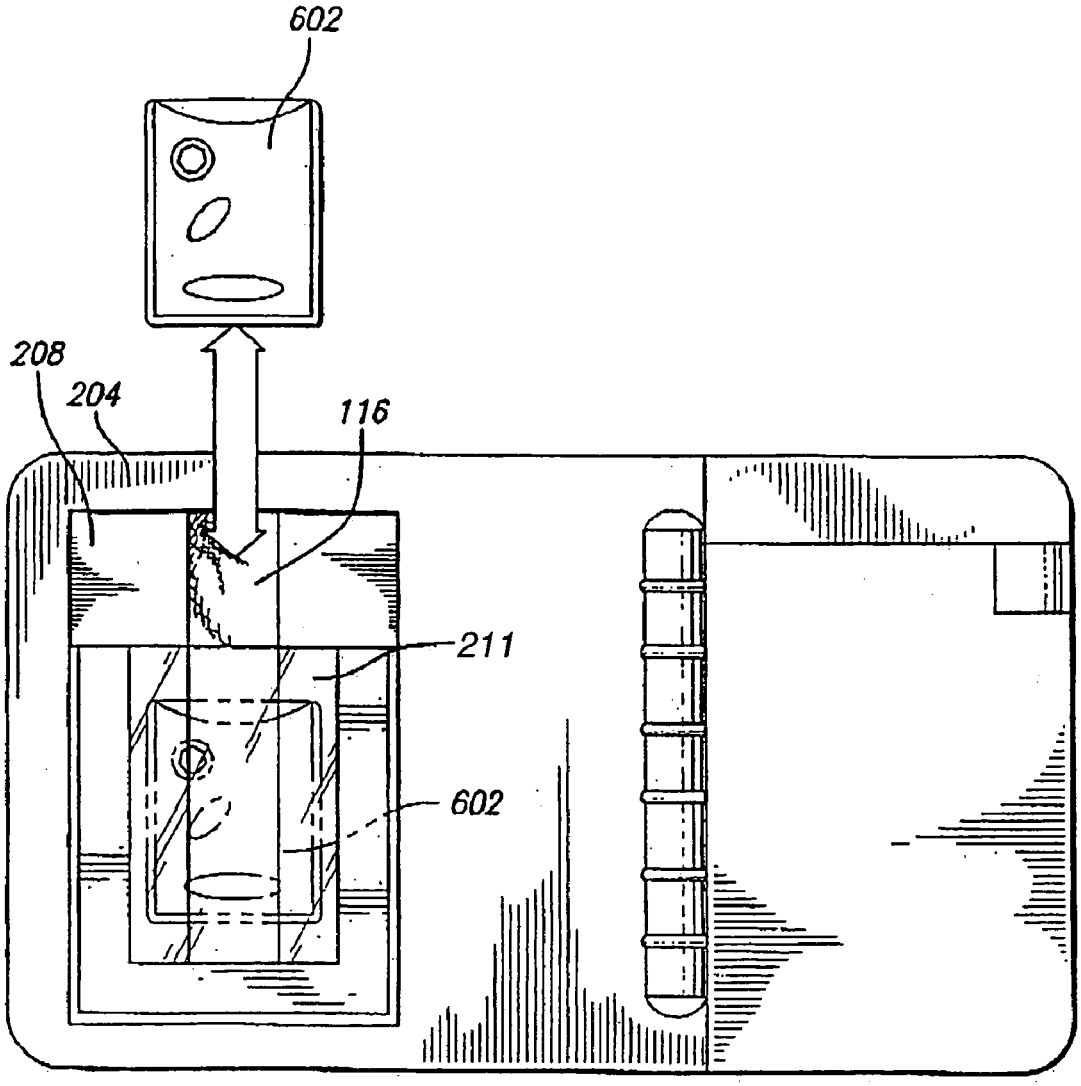
FIG. 6 illustrates the insertion or removal of a pager into the two-way pocket from the inside of the notebook.
Figure 7:
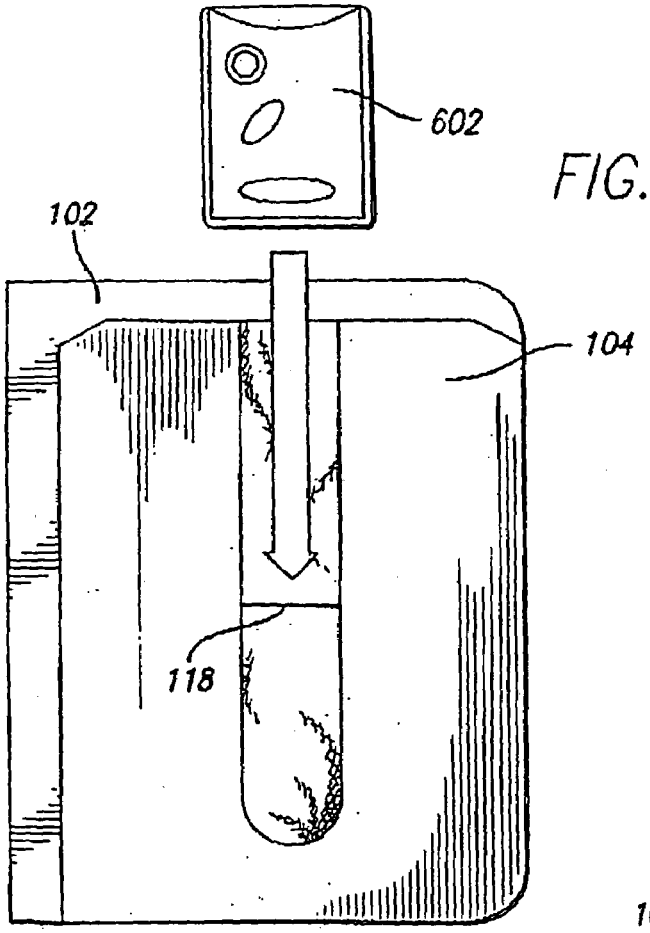
FIG. 7 illustrates the ability to clip a pager or other personal electronic assistant onto the front exterior surface of the notebook of FIG. 1.
Figure 8:
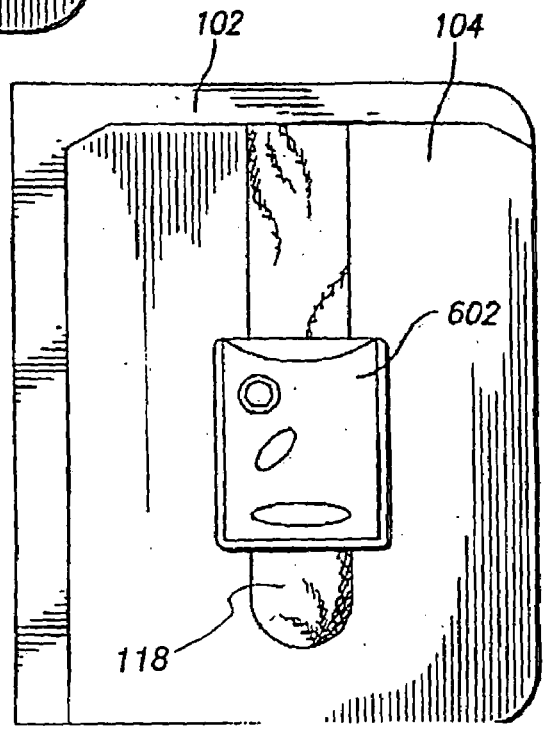
FIG. 8 illustrates a pager clipped onto the front exterior surface of the notebook.

In another embodiment of the present invention, shown in FIGS. 1 and 6, the elastic panels 116 are arranged such that they form an elongated opening or channel 118. The edges of the channel 118 are preferably reinforced by stitching or fabric to provide added strength to the elastic panels in that area. A small electronic device which is equipped with a clip, such as a pager 602, can be inserted into the storage pocket 250. Because such small items may tend to shift as the notebook 100 is moved and/or carried, these items may be secured by a clip that commonly forms a part of such devices through the channel 118. Accordingly, these devices are secured within the storage pocket 250 both by the action of the elastic, which tightens the pocket around the pager 602, and by the clip. It should be understood that the channel is optional, and need not be included. With reference to FIG. 7, it will also be understood that a pager 602 stored in the pocket can be secured to the front exterior surface by inserting the clip in the channel 118. The pager 602 will then be firmly secured to the front of the binder as shown in FIG. 8.

It is intended here to describe a preferred embodiment of the present invention. It will be understood that certain modifications and variations can be made without departing from the scope of the present invention. For instance, alternate embodiments of the present invention may be either larger or smaller in scale than the embodiment shown, may include more than one two-way pocket or additional organizational tools with the binder, may have multiple U-shaped cutouts, Y-shaped cut-outs (FIG. 9), larger elastic panels or multiple elastic panels. The two-way pocket may also be oriented to face the side, rather than the top of a notebook.

The invention claimed is:

1. A notebook comprising:

a foldable cover having internal and exterior surfaces;

a rigid support sheet enclosed within said cover;

an opening in said support sheet;

an exterior pocket flap secured to the exterior surface of the cover and covering at least a part of said opening; and an interior pocket flap secured to the interior surface of the cover, covering at least a portion of said opening and aligned with said exterior pocket flat, thereby forming a two-way storage pocket such that a personal electronic assistant can be inserted or removed from the storage pocket formed between said exterior and interior pocket flaps from the inside or the outside of the notebook.

2. The notebook of claim 1, wherein at least one of said pocket flaps includes a cut-out section and one or more elastic panels that at least partially cover the cut-out section.

3. The notebook of claim 1, wherein at least one of the exterior and interior pocket flaps includes structure defining a window, said window allowing visual access to a personal electronic assistant device between the pockets.

4. The notebook of claim 3, wherein the window is made of transparent plastic.

5. The notebook of claim 3, wherein the window is made of mesh.

6. The notebook of claim 3 wherein the window is an opening.

7. The notebook of claim 3, wherein the window is configured and positioned so that, when a personal electronic assistant having a display screen is placed in the storage pocket, substantially the entire display screen is visible through the window.

8. The notebook of claim 3, wherein the window is configured and positioned so that when a cellular telephone having number keys is inserted between said pocket flaps, the number keys are visible through said window.

9. The notebook of claim 2 wherein at least one of said pocket flaps is attached to the cover by one or more elastic strips.

10. The notebook of claim 1, further comprising a closure attached to one of the pocket flaps for holding the exterior pocket closed.

11. The notebook of claim 1, further comprising a hook and loop closure attached to one of the pocket flaps for holding the exterior pocket closed.

12. A notebook comprising:

a foldable cover having rectangular internal and external surfaces, a rigid support sheet enclosed within said cover;

a rectangular opening in said support sheet;

an exterior pocket flap defining a channel;

a plurality of elastic panels by which the exterior pocket flap is secured to the cover in alignment with said opening;

an elastic panel secured within said channel so that the exterior pocket flap can be expanded;

an interior pocket flap secured to said cover in alignment with said opening and said exterior pocket flap, said interior pocket flap defining a window;

a pair of tabs attached to said interior pocket flap and a pair of hook and loop fasteners attached to said tabs by which said interior pocket flap can be tightened against said cover; and a storage pocket being formed within said opening and between said pocket flaps for receiving a personal electronic assistant.

* * * * *